US010634341B2

(12) United States Patent
Hellewell et al.

(10) Patent No.: US 10,634,341 B2
(45) Date of Patent: Apr. 28, 2020

(54) OVERFIRE AIR SYSTEM FOR LOW NITROGEN OXIDE TANGENTIALLY FIRED BOILER

(71) Applicant: General Electric Technology GmbH, Baden (CH)

(72) Inventors: Todd D. Hellewell, Windsor, CT (US); Bryan Walter Mruk, Chicopee, MA (US); Christopher David Siriani, Agawam, MA (US)

(73) Assignee: General Electric Technology GmbH, Baden (CH)

( * ) Notice: Subject to any disclaimer, the term of this patent is extended or adjusted under 35 U.S.C. 154(b) by 0 days.

(21) Appl. No.: 15/244,243

(22) Filed: Aug. 23, 2016

(65) Prior Publication Data

US 2018/0058687 A1 Mar. 1, 2018

(51) Int. Cl.

| | |
|---|---|
| ***F23M 3/00*** | (2006.01) |
| ***F23D 1/00*** | (2006.01) |
| ***F23C 6/04*** | (2006.01) |
| ***F23C 7/02*** | (2006.01) |
| ***F22B 29/06*** | (2006.01) |
| ***F23D 1/02*** | (2006.01) |
| ***F23L 9/02*** | (2006.01) |

(52) U.S. Cl.

CPC ..... *F23D 1/005* (2013.01); *F22B 29/065* (2013.01); *F23C 6/047* (2013.01); *F23C 7/02* (2013.01); *F23D 1/02* (2013.01); *F23L 9/02* (2013.01); *F23C 2201/101* (2013.01); *F23D 2201/20* (2013.01)

(58) Field of Classification Search

CPC ..... F23D 1/005; F23D 1/02; F23D 2201/20; F23L 9/02; F23C 7/02; F23C 6/045

USPC ..... 431/9; 122/6 A, 235.23; 110/347, 265

See application file for complete search history.

(56) References Cited

U.S. PATENT DOCUMENTS

| | | | | |
|---|---|---|---|---|
| 4,987,862 | A * | 1/1991 | Wittchow | F22B 29/065 122/235.12 |
| 5,315,939 | A | 5/1994 | Rini et al. | |
| 5,899,172 | A | 5/1999 | Dallen et al. | |
| 5,901,669 | A | 5/1999 | Phelps, Sr. | |
| 2004/0221777 | A1 | 11/2004 | Hart et al. | |
| 2005/0235888 | A1 | 10/2005 | Mann et al. | |
| 2007/0234938 | A1 | 10/2007 | Briggs, Jr. et al. | |
| 2009/0277364 | A1 | 11/2009 | Donais et al. | |
| 2010/0203461 | A1 | 8/2010 | Maly et al. | |

(Continued)

FOREIGN PATENT DOCUMENTS

| | | | |
|---|---|---|---|
| CN | 103968371 | A | 8/2014 |
| CN | 104633652 | A | 5/2015 |
| DE | 195 14 302 | A1 | 10/1996 |

OTHER PUBLICATIONS

International Search Report and Written Opinion issued in connection with corresponding PCT Application No. PCT/EP2017/069821 dated Oct. 11, 2017.

*Primary Examiner* — Vivek K Shirsat

(74) *Attorney, Agent, or Firm* — Eversheds Sutherland (US) LLP

(57) ABSTRACT

The present application provides a tangentially fired boiler. The tangentially fired boiler may include a combustion chamber and an overfire air system positioned about the combustion chamber. The overfire air system may include a number of overfire air windboxes positioned in a horizontal orientation.

19 Claims, 2 Drawing Sheets

(56) References Cited

U.S. PATENT DOCUMENTS

| | | | | |
|---|---|---|---|---|
| 2011/0094105 | A1 | 4/2011 | Tatsumi et al. | |
| 2011/0302901 | A1 | 12/2011 | Xu et al. | |
| 2012/0311842 | A1 | 12/2012 | Mann | |
| 2014/0212825 | A1 | 7/2014 | Kenney et al. | |
| 2014/0308620 | A1* | 10/2014 | Deng | F23L 9/02 431/177 |
| 2016/0146462 | A1* | 5/2016 | Cohen | F23C 6/047 110/342 |

* cited by examiner

OVERFIRE AIR SYSTEM FOR LOW NITROGEN OXIDE TANGENTIALLY FIRED BOILER

TECHNICAL FIELD

The present application and the resultant patent relate generally to a pulverized solid fuel fired furnace system and more particularly relate to an advanced overfire air system for use with a tangentially fired boiler for ultra-low levels of nitrogen oxides with improved efficiency.

BACKGROUND OF THE INVENTION

Generally described, a tangentially fired boiler includes a combustion chamber in which a combination of a flow of a pulverized solid combustible fuel and a flow of air is combusted to generate heat. The heat may be used for any suitable purpose such as for driving a steam turbine for producing steam and the like. The flow of combustible fuel and the flow of air may be introduced along a horizontal plane from multiple locations about the perimeter of the combustion chamber. Specifically, the flow of fuel and the flow of air may be directed tangentially to a focal region along the horizontal plane. This focal region may be substantially concentric within the combustion chamber such that combustion results in the controlled formation of a spiraling fireball.

Overfire air is combustion air that may be tangentially injected into the combustion chamber between the primary firing zone and a furnace outlet. Thorough mixing of the overfire air with the gases in the fireball may achieve low levels of nitrogen oxides, carbon monoxide, and other types of emissions with an overall increase in combustion efficiency.

Such boilers may use a combination of spiral and vertical water tubes positioned about the walls of the combustion chamber. The spiral tubes may benefit from the averaging of the lateral heat absorption variation in each water tube. Moreover, the location of the spiral to vertical transition of the water tubes may have an impact on the number of turns of the spiral wall. Specifically, too many turns may result in an increased pressure drop while too few turns may result in uneven spiral wall tube outlet temperatures. Such uneven outlet temperatures may cause thermal stresses within the tubes and the headers.

SUMMARY OF THE INVENTION

The present application and the resultant patent thus provide a tangentially fired boiler. The tangentially fired boiler may include a combustion chamber and an overfire air system positioned about the combustion chamber. The overfire air system may include a number of overfire air windboxes positioned in a substantially horizontal orientation.

The present application and the resultant patent further provide a method of operating a tangentially fired boiler. The method may include the steps of combusting a flow of fuel and a flow of air in a combustion chamber, circulating a fluid in a spiral configuration around the combustion chamber, and flowing overfire air into the combustion chamber via a number of horizontal overfire windboxes positioned above the spiral configuration.

The present application and the resultant patent further provide a tangentially fired boiler. The tangentially fired boiler may include a combustion chamber, a number of tubes positioned in a spiral configuration about the combustion chamber, and an overfire air system positioned about the combustion chamber. The overfire air system may include a number of overfire air windboxes positioned in a horizontal orientation.

These and other features and improvements of the present application and resultant patent will become apparent to one of ordinary skill in the art upon review of the following detailed description and technique in conjunction with the several drawings and the appended claims.

DETAILED DESCRIPTION

Figure 1:
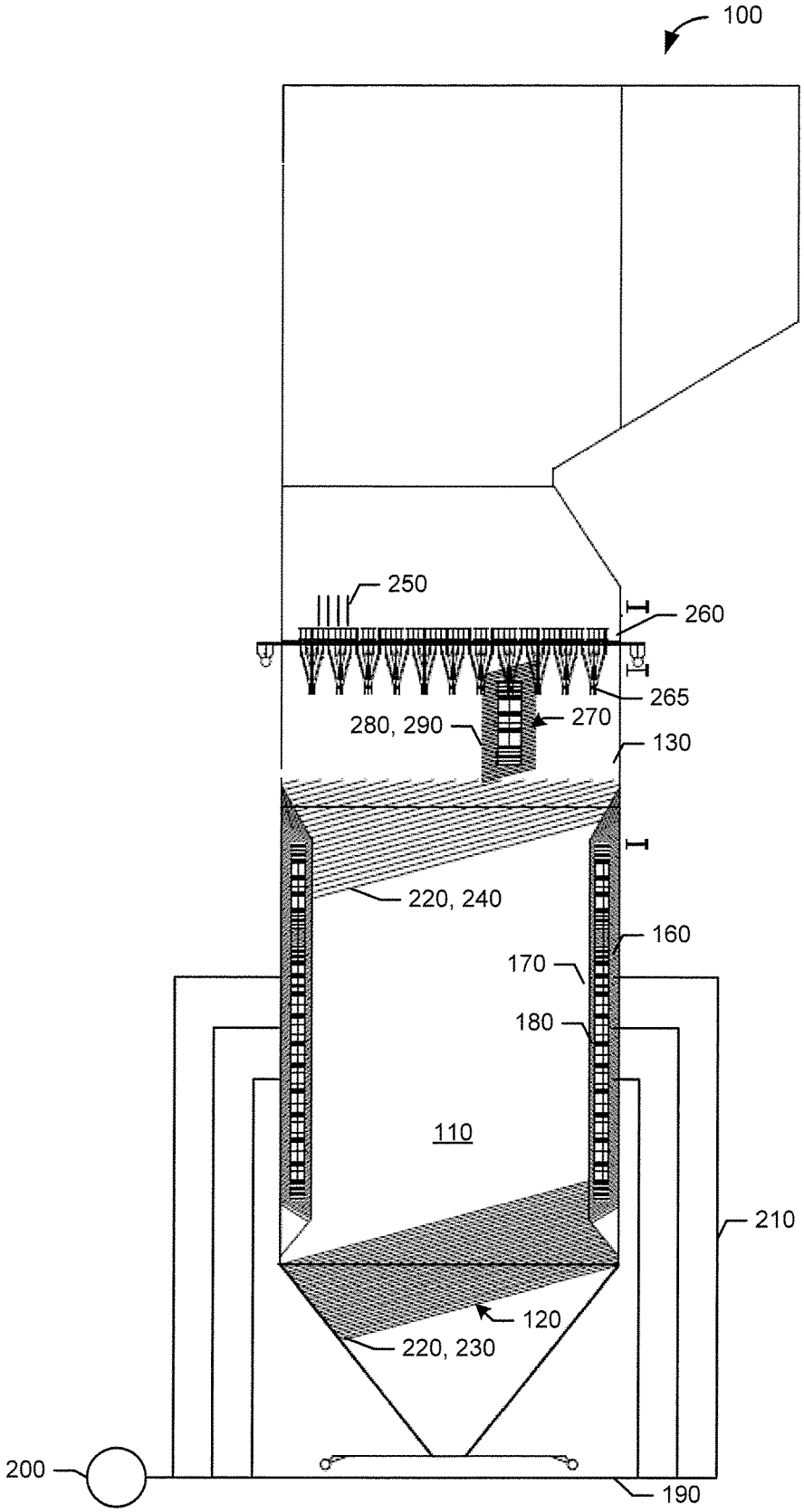
FIG. 1 is a schematic diagram of a solid fuel fired steam generator including an overfire air system.

Referring now to the drawings, in which like numerals refer to like elements throughout the several views, FIG. 1 shows an example of a pulverized solid fuel fired boiler 100. The boiler 100 may include a combustion chamber 110. A pulverized solid fuel such as a flow of coal and a flow of air may be combusted therein. The hot gases that are produced from the combustion of the pulverized solid fuel and the air rise upwardly in the combustion chamber 110 and exchange heat with water passing through a number of water tubes 120 positioned within the walls 130 thereof. (Other types of fluids may be used herein.) The hot gases then may exit the combustion chamber 110 through a horizontal pass which in turn leads to a rear gas pass. The boiler 100 may provide steam generated therein to a turbine such as used in a turbine/generator set or for any other suitable purpose.

The boiler 100 may include one or more windboxes 160. The windboxes may be positioned about the corners or the walls of the combustion chamber 110. Each windbox 160 may be provided with a number of air compartments 170. Air may be supplied from a suitable source and injected into the combustion chamber 110 via the air compartments 170. Each windbox 160 also may include a number of fuel compartments 180. A pulverized solid fuel may be injected into the combustion chamber 110 via the fuel compartments 180. The solid fuel may be supplied to the fuel compartments 180 by a pulverized solid fuel supply 190. The pulverized solid fuel supply 190 may include a pulverizer 200. The pulverizer 200 may be in communication with the fuel compartments 180 via a number of pulverized solid fuel ducts 210. The air stream generated by the air source may transport the pulverized solid fuel from the pulverizer 200, through the pulverized solid fuel ducts 210, through the fuel compartments 180, and into the combustion chamber 110.

As described above, the walls 130 of the combustion chamber 110 may have a number of the water tubes 120 running therethrough. The water tubes 120 positioned about the combustion chamber 110 may have a spiral orientation 220. The spacing of water tubes 120 along the length of the walls 130 may vary. Specifically, the water tubes 120 may have a first or a close configuration 230 about a bottom of the combustion chamber 110 and may have a second or a separated configuration 240 about a top of the combustion chamber 110. The spacing between the water tubes 120 may vary. The water tubes 120 may transition from the spiral orientation 220 to a vertical orientation 250 at a spiral to vertical transition line 260. The transition line 260 generally may be positioned close to the top of the combustion chamber 110. A number of finger straps 265 may be positioned about the spiral to vertical transition line 260. The finger straps 265 may support the spiral orientation 220 of the water tubes 120. Other components and other configurations may be used herein.

The combustion chamber 110 may include an overfire air system 270. As described above, the overfire air system 270 may introduce separated overfire air (SOFA) into an upper region of the combustion chamber 110. The overfire air system 270 may include a number of overfire air windboxes 280. Similar to the windboxes described above, the windboxes include a number of air compartments 170 and fuel compartments 180. The overfire air windboxes 280 generally include a vertical orientation 290. The overfire air windboxes 280 generally may be positioned below the spiral to vertical transition line 260 of the water tubes 120. Air injected normal to the surface of the combustion chamber walls 130 intercepts the approaching flow of the fireball vortex. The array within the windboxes 280 generally may tilt through about thirty degrees and yaw through about twenty-five degrees. The boiler 100 and the components thereof are described herein for the purpose of example only. Other types of boilers 100 and boiler components may be used.

Figure 2:
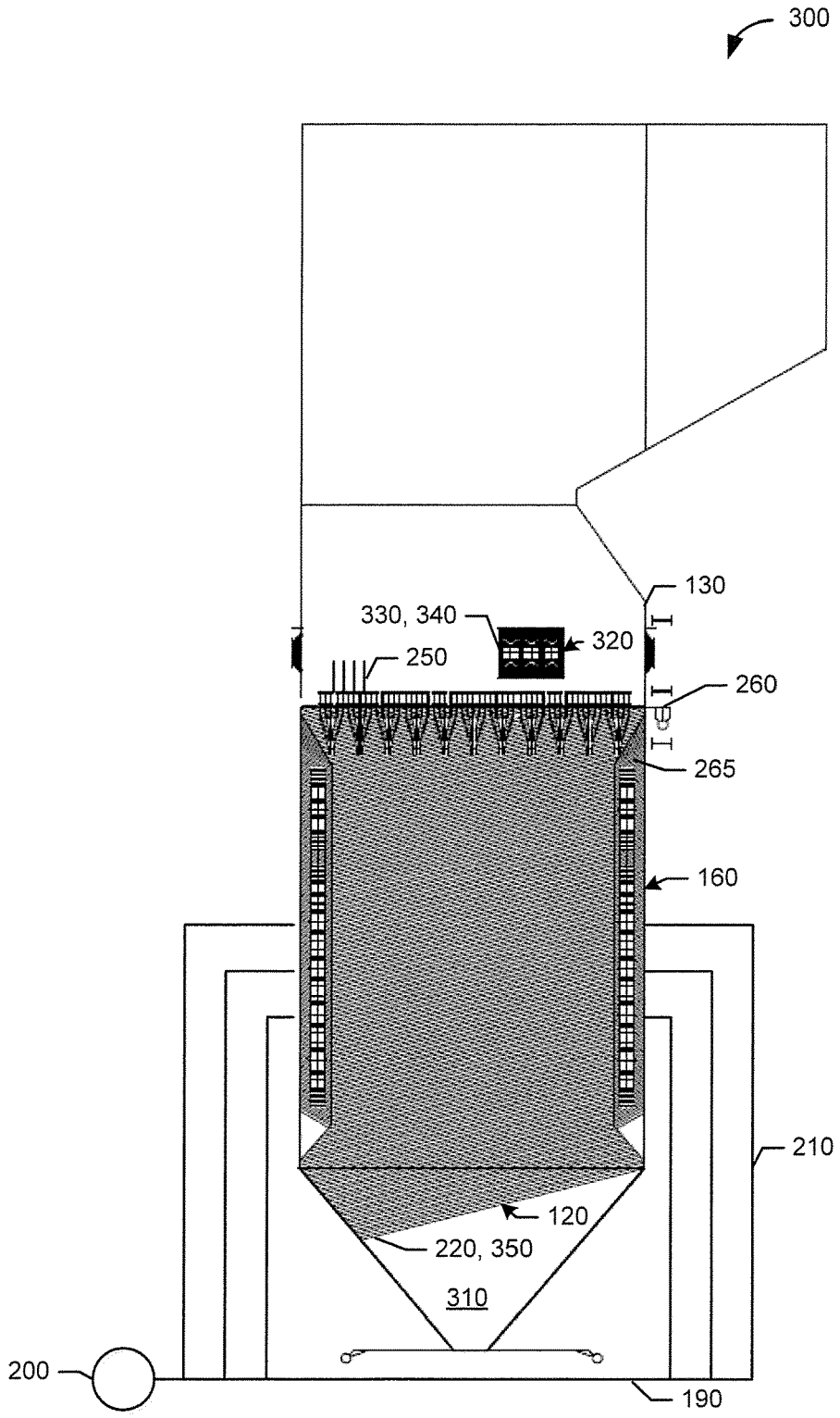
FIG. 2 is a schematic diagram of a solid fuel fired steam generator including an overfire air system as maybe described herein.

FIG. 2 shows an example of a boiler 300 as may be described herein. The boiler 300 may include a combustion chamber 310. The combustion chamber 310 and the component thereof may be substantially similar to the combustion chamber 110 described above. The combustion chamber 310 also may include an overfire air system 320. The overfire air system 320 may include a number of overfire air windboxes 330. In this example, the overfire air windboxes 330 may have a substantially horizontal orientation 340 as opposed to the vertical orientation 280 described above. In other words, the overfire air windboxes 330 may be rotated by about ninety degrees (90°) or so. Other angles may be used herein.

Given that a typical overfire air windbox 330 may be about two to four meters tall but only about a meter wide, the use of the horizontal orientation 340 allows the overall length of the combustion chamber 310 to be reduced by about one to three meters. Other sizes, shapes, and configurations may be used herein. Moreover, the use of the horizontal orientation 340 allows the spiral to vertical transition line 260 of the water tubes 120 to be lower and positioned underneath the overfire air windboxes 330. This lower position also allows the water tubes 120 to have a substantial uniform spacing 350 along the length of the combustion chamber 310. Other components and other orientations also may be used herein.

The use of the horizontal orientation 340 of the overfire air windboxes 330 thus allows for the optimization of the spiral to vertical transition line 260 for an improved overall pressure drop and minimum once through load. Likewise, the horizontal orientation 340 of the overfire air windboxes 330 may minimize shading of the water tubes 120 in the vertical configuration 250 above the transition line 260. Specifically, the vertical orientation 290 of the overfire air windboxes 280 may cause the water tubes 120 to be bent so as to accommodate the existing overfire air windboxes 280. The bent water tubes 120 may receive no direct heating from the fireball and thus may become cooler than the water tubes adjacent to the windboxes 280 so as to create thermal stresses. The reduced height of the horizontal orientation 340 of the overfire air windboxes 330 thus will allow for a more uniform tube-to-tube outlet temperature and a reduction in thermal stress.

Injecting the separated overfire air via the overfire air windboxes 330 in the horizontal orientation 340 as described herein thus may provide thorough mixing of the overfire air with the gases of the spiraling fireball for achieving a minimum or at least reduced emission levels with a maximum or at least improved overall combustion efficiency. Reducing the height of the combustion chamber walls 130 likewise may improve the overall thermal performance of the boiler 100 in a less expensive, simplified design.

It should be apparent that the foregoing relates only to certain embodiments of the present application and the resultant patent. Numerous changes and modifications may be made herein by one of ordinary skill in the art without departing from the general spirit and scope of the invention as defined by the following claims or the equivalents thereof

We claim:

1. A tangentially fired boiler, comprising:

a combustion chamber defining a primary firing zone having first plurality of windboxes positioned thereabout, each of the first plurality of windboxes comprising a respective first plurality of compartments, each of the compartments of each windbox having vertical orientation with respect to each other;

and an overfire air system positioned about the combustion chamber downstream of the primary firing zone;

the overfire air system comprising a plurality of overfire air windboxes to inject separated overfire air into the combustion chamber, each overfire air windbox of the plurality of overfire air windboxes comprising a respective second plurality of compartments, wherein the compartments of each respective second plurality of compartments comprise a horizontal orientation with respect to each other.

2. The tangentially fired boiler of claim 1, wherein the combustion chamber comprises a wall with a plurality of tubes therein.

3. The tangentially fired boiler of claim 2, wherein each tube of the plurality of tubes comprises a spiral configuration.

4. The tangentially fired boiler of claim 3, wherein the spiral configuration extends to a spiral to vertical transition line.

5. The tangentially fired boiler of claim 4, wherein the overfire air system is positioned above the spiral to vertical transition line.

6. The tangentially fired boiler of claim 4, wherein each tube of the plurality of tubes comprises a vertical configuration above the spiral to vertical transition line.

7. The tangentially fired boiler of claim 2, wherein the plurality of tubes comprises a plurality of water tubes.

8. The tangentially fired boiler of claim 2, wherein the plurality of tubes comprises a substantially uniform spacing.

9. The tangentially fired boiler of claim 1, wherein the respective first plurality of compartments of each windbox of the first plurality of windboxes comprises an air compartment and a fuel compartment.

10. The tangentially fired boiler of claim 1, wherein each windbox of the plurality of overfire air windboxes may tilt through thirty degrees and yaw through twenty-five degrees.

11. The tangentially fired boiler of claim 1, further comprising a pulverized solid fuel supply in communication with the first plurality of windboxes.

12. The tangentially fired boiler of claim 1, wherein each windbox of the plurality of overfire air windboxes comprises a height of less than two meters.

13. The tangentially fired boiler of claim 1, wherein each windbox of the plurality of overfire air windboxes comprises an air compartment and a fuel compartment.

14. A method of operating a tangentially fired boiler, comprising:

combusting a flow of fuel and a flow of air in a combustion chamber;

circulating a fluid in a spiral configuration around the combustion chamber; and flowing overfire air into the combustion chamber via a plurality of overfire air windboxes wherein each overfire air windbox of the plurality of overfire air windboxes comprises a respective plurality of overtire air compartments horizontally arranged with respect to each other, and wherein the overfire air windboxes are positioned above the spiral configuration.

15. A tangentially fired boiler, comprising:

a combustion chamber;

a plurality of tubes positioned in a spiral configuration about the combustion chamber; and an overfire air system positioned about the combustion chamber;

the overfire air system comprising a plurality of overfire air windboxes to inject overfire air into the combustion chamber, each overfire air windbox of the plurality of overtire air windboxes comprising a respective plurality of compartments, wherein the compartments of each respective plurality of compartments comprise a horizontal orientation with respect to each other.

16. The tangentially fired boiler of claim 15, wherein the spiral configuration extends to a spiral to vertical transition line.

17. The tangentially fired boiler of claim 16, wherein the overfire air system is positioned above the spiral to vertical transition line.

18. The tangentially fired boiler of claim 15, wherein the plurality of tubes comprises a substantially uniform spacing.

19. The tangentially fired boiler of claim 15, wherein each windbox of the plurality of overfire air windboxes comprises a height of less than two meters.

* * * * *